US005386982A

United States Patent [19]

Kawano

[11] Patent Number: 5,386,982

[45] Date of Patent: Feb. 7, 1995

[54] PAPER FEEDING APPARATUS

[75] Inventor: Hiroshi Kawano, Kawasaki, Japan

[73] Assignee: Ricoh Company, Ltd., Tokyo, Japan

[21] Appl. No.: 160,805

[22] Filed: Dec. 3, 1993

[30] Foreign Application Priority Data

Dec. 3, 1992 [JP] Japan ..... 4-324327

[51] Int. Cl.[6] ..... B65H 5/00

[52] U.S. Cl. ..... 271/10; 271/126; 271/145

[58] Field of Search ..... 271/126, 145, 147, 157, 271/162, 164, 169, 170, 171, 10

[56] References Cited

U.S. PATENT DOCUMENTS 4,595,191 6/1986 Uchiyama et al. ..... 271/170
5,060,922 10/1991 Shibusawa et al. .

FOREIGN PATENT DOCUMENTS 5217032 2/1983 Japan ..... 271/126
61-55040 3/1986 Japan ..... 271/145
3-152026 6/1991 Japan ..... 271/126

*Primary Examiner*—David H. Bollinger
*Attorney, Agent, or Firm*—Oblon, Spivak, McClelland, Maier & Neustadt

[57] ABSTRACT

A paper sheet feeding apparatus which includes a paper sheet separating device and a paper sheet tray, with the paper separating device further including a pick-up-roller, a feeding roller and a paper sheet separating roller. Significantly, a curl holding member or paper holding member is provided on the paper sheet feeding part side (or, in other words, on the body of the apparatus) so that an operator can easily load paper and the paper holding member is not broken in the case of paper sheet jam. Preferably, the paper holding member is movable, such that it does not obstruct positioning of a paper tray or clearing of paper jams. Further, since the paper holding members is mounted separate from the paper tray, loading of paper into the tray is relatively simple.

24 Claims, 6 Drawing Sheets

FIG. 4
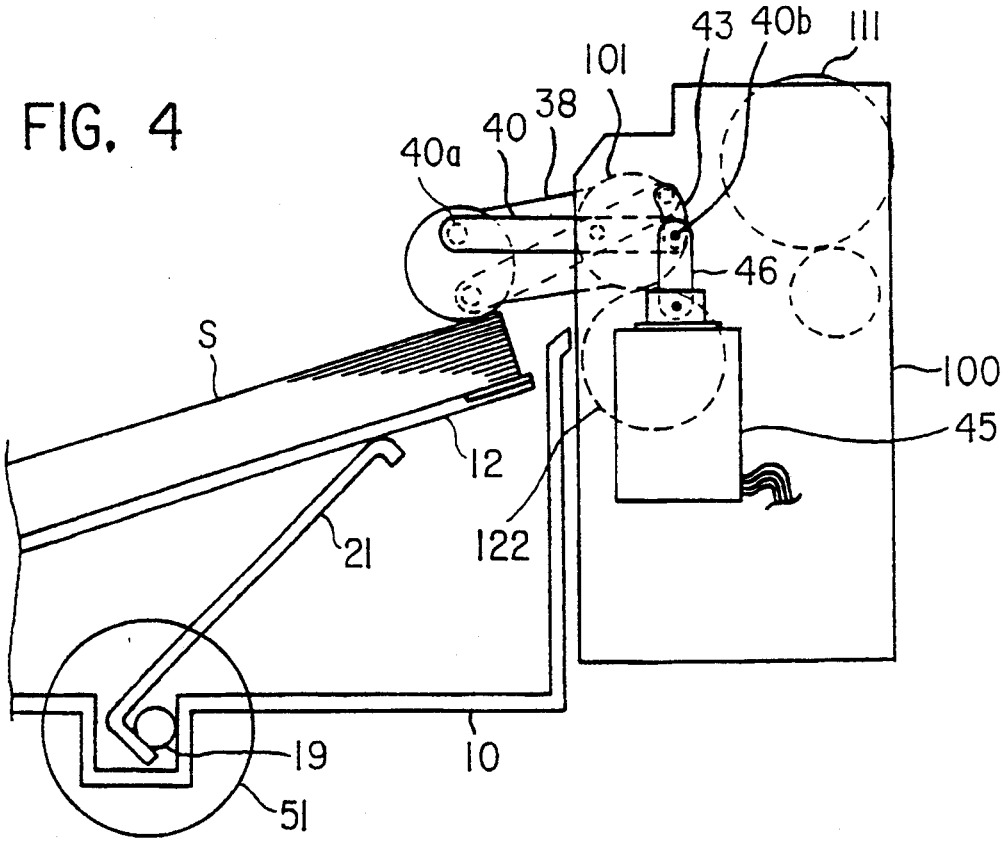
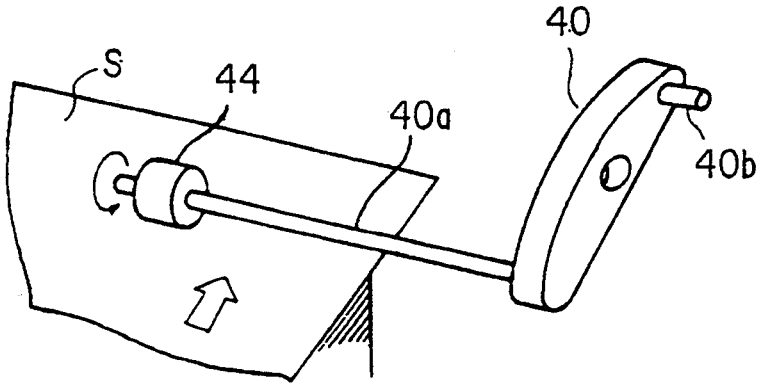
FIG. 5

PAPER FEEDING APPARATUS

BACKGROUND OF THE INVENTION

1. Field of the Invention

The invention relates to a paper feeding apparatus, particularly an apparatus in which a paper tray is removably mounted or retractably mounted with respect to a main body of the apparatus.

2. Description of the Related Art

Changes in temperature or humidity affect paper sheets loaded in a paper tray of a copying machine or a printer, particularly if they have been left for a long period of time. Such sheets can retain moisture or humidity, especially in their peripheral parts. In addition, expansion and contraction of the sheets can occur resulting in curling of the peripheral parts of the sheets. By this curling, the peripheral parts of the paper move out of a holding member which is provided in the paper tray, and paper jams or paper skews occur when a sheet is fed into the main body.

To solve these problems, side fences for holding both sides of paper sheets which are loaded in the paper sheet tray, and holding members (corner claws) for holding both top ends of the sheets are provided to prevent the sheets from curling. In this case, the side fences become obstacles and increase the time required to supply the paper, particularly in loading paper into the paper tray.

In Japanese Laid Open Patent No. 1-92137, a paper feeding apparatus having a paper holding member upstream of a feeding roller for holding an upper surface of paper sheets is disclosed. However, since the holding member holds only a center portion of the paper sheets loaded in a paper cassette, the holding member can not prevent the paper from curling. Further, in case of paper jams, one or more paper sheets could be damaged if an operator pulls out the paper tray to supply additional paper.

SUMMARY OF THE INVENTION

An object of the present invention is to overcome the above and other problems encountered in the aforementioned art.

It is another object of the present invention to provide a paper sheet feeding apparatus capable of preventing curling of paper sheets.

It is a further object of the present invention to provide a paper sheet feeding apparatus which is capable of preventing paper sheets from skewing, and which is capable of reducing delays in feeding and/or loading of paper.

It is a further object of the present invention to provide a paper sheet feeding apparatus which is capable of easily supplying paper sheets without damage to a paper sheet holding member as in the case of a paper jam.

The above and other objects of the present invention are achieved by a paper feeding apparatus which includes a paper tray which is detachable from a main body. Advantageous aspects of the present invention are also applicable to various types of feeding apparatus, for example in which the paper tray is slidable or retractable (as a drawer) with respect to the body of the apparatus. The paper feeding apparatus includes a paper or curl holding member, which prevents (or restrains) end portions of the paper sheets in the paper sheet tray from curling, with the curl holding members or paper holding members provided on a main body of the apparatus.

BRIEF DESCRIPTION OF THE DRAWINGS

Other objects and further features of the present invention will become apparent from the following detailed description, particularly when read in conjunction with the accompanying drawings, wherein:

FIG. 4 is a side sectional view showing an additional aspect of the paper feeding apparatus according to a further embodiment of the invention;

FIG. 5 is a perspective view showing a curl holding member or paper holding member, of the paper feeding apparatus according to a still further embodiment;

DESCRIPTION OF THE PREFERRED EMBODIMENT

Figure 1:
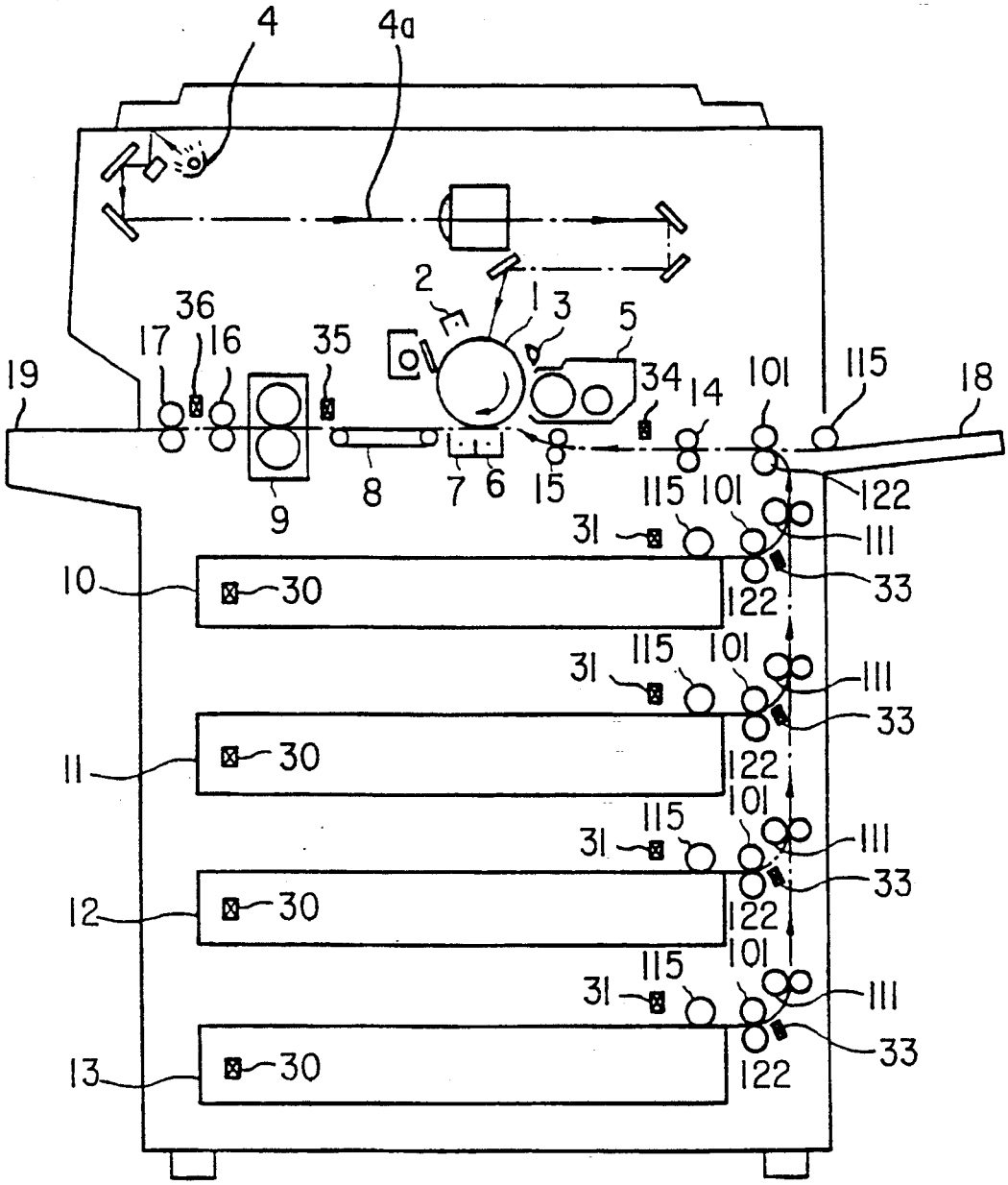
FIG. 1 is a sectional view showing an electrophotographic copier.

Referring to FIG. 1, the overall structure and operation of an electrophotographic copier according to the present invention will be described. In operation, a photoconductive member 1 rotates around its center axis in a direction shown by the arrow ( e.g., the clockwise direction as shown), and a charger provides a uniform positive or negative electric charge on the photoconductive member 1. Next, an eraser 3 illuminates an area except for an image area (e.g., margin areas), whereby, a part of the electric charge on the photoconductive member 1 is removed. In addition, a reflected light 4*a* which is provided by a light source 4 and reflected on a document, is reflected by mirrors. The reflected light 4*a* exposes the photoconductive member 1, whereby a latent image (which is, for example, a negative image to the document image) is formed, with the latent image corresponding to the image on the document. Next, toner is attached to the latent image of the photoconductive member 1 by a developing device 5, whereby a visible toner image is formed on the photoconductive member 1.

Paper sheets which are loaded in paper trays 10, 11, 12, 13, or a manual tray 18, are fed one by one to a paper feeding part from the paper trays 10, 11, 12, 13 or the manual tray 18, by one or more pick-up rollers 115. The thus fed paper sheets are then transported downward by a paper sheet separating arrangement which includes a feeding roller 101 and a separating roller 122.

Next, a paper sheet, which has passed through intermediate rollers 14 and/or 111, is fed to a transferring device 6, with the feeding of the paper sheet timed to match a position of a visible toner image on the photoconductive member 1 by resist rollers 15. The paper sheet, upon which is transferred a toner image in the transferring device 6, is then separated from the photoconductive member 1 by a separating device 7. Thereafter, the paper sheet with the toner image thereon is fed by a transporting belt 8 to a fixing device 9, and the toner on the paper sheet is fixed on the paper sheet by the fixing device 9. Discharging rollers 16, 17 then discharge the paper sheet to a discharging tray 19.

Tray set sensors 30 detect whether or not the paper trays 10, 11, 12, 13 are set in place. In addition, the paper sheet end sensors 31 detect whether or not there are any paper sheets in the paper trays 10, 11, 12 and 13. Paper sheet detecting sensors 33, 34, 35, 36 are also provided to detect paper jams or the presence of paper at a particular location. In the main body are provided the paper feeding and separating elements or separating parts which include the pick-up rollers 115, feeding rollers 101 and separating rollers 122. On the other hand, the paper trays 10, 11, 12 and 13 are detachably mounted to be removable from the front side of the main body. Thus, the paper sheet feeding apparatus includes the paper sheet separating elements and the paper trays 10, 11, 12 or 13.

Figure 2:
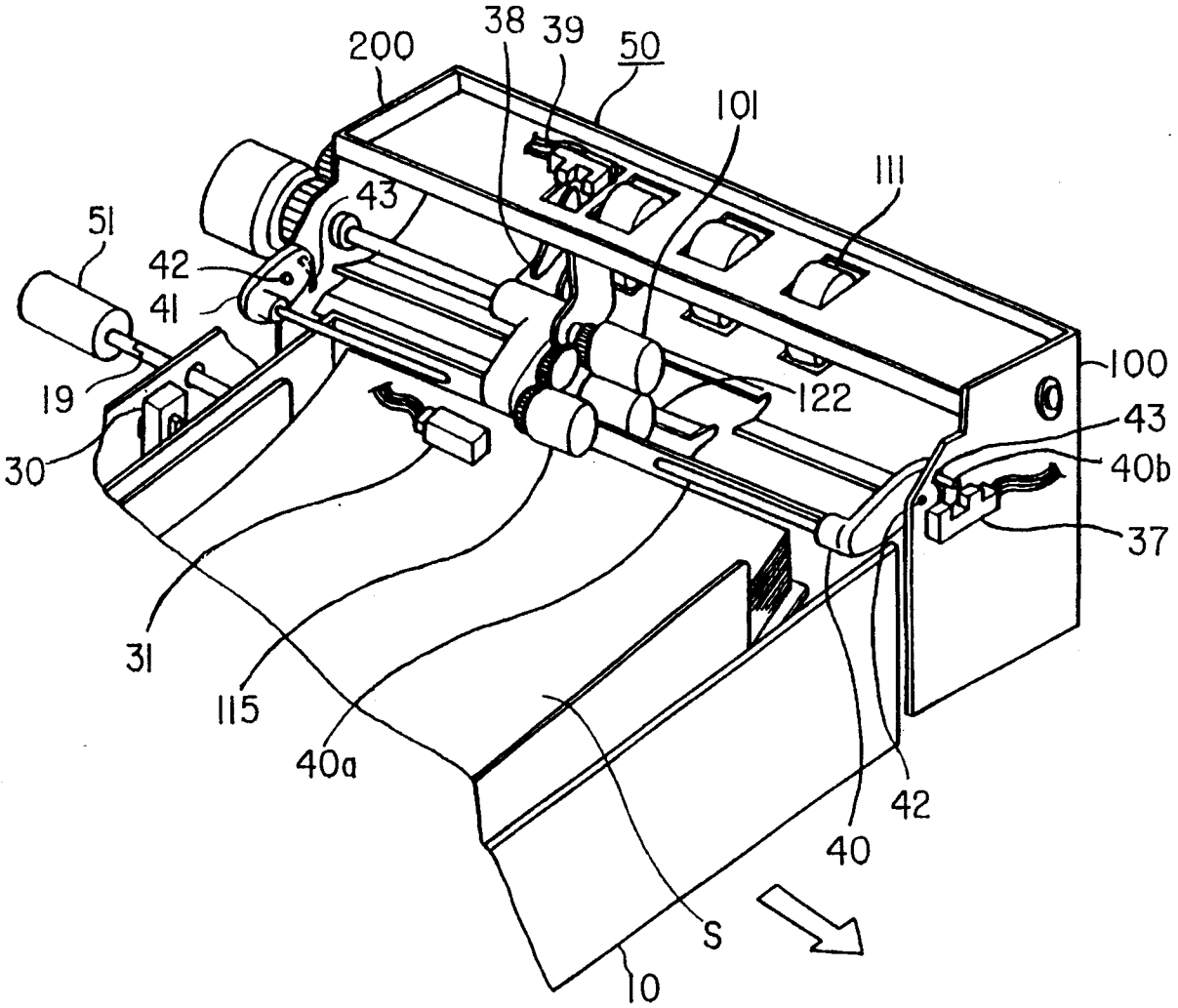
FIG. 2 is a perspective view showing a significant portion of a paper feeding apparatus according to an embodiment of the present invention.
Figure 3:
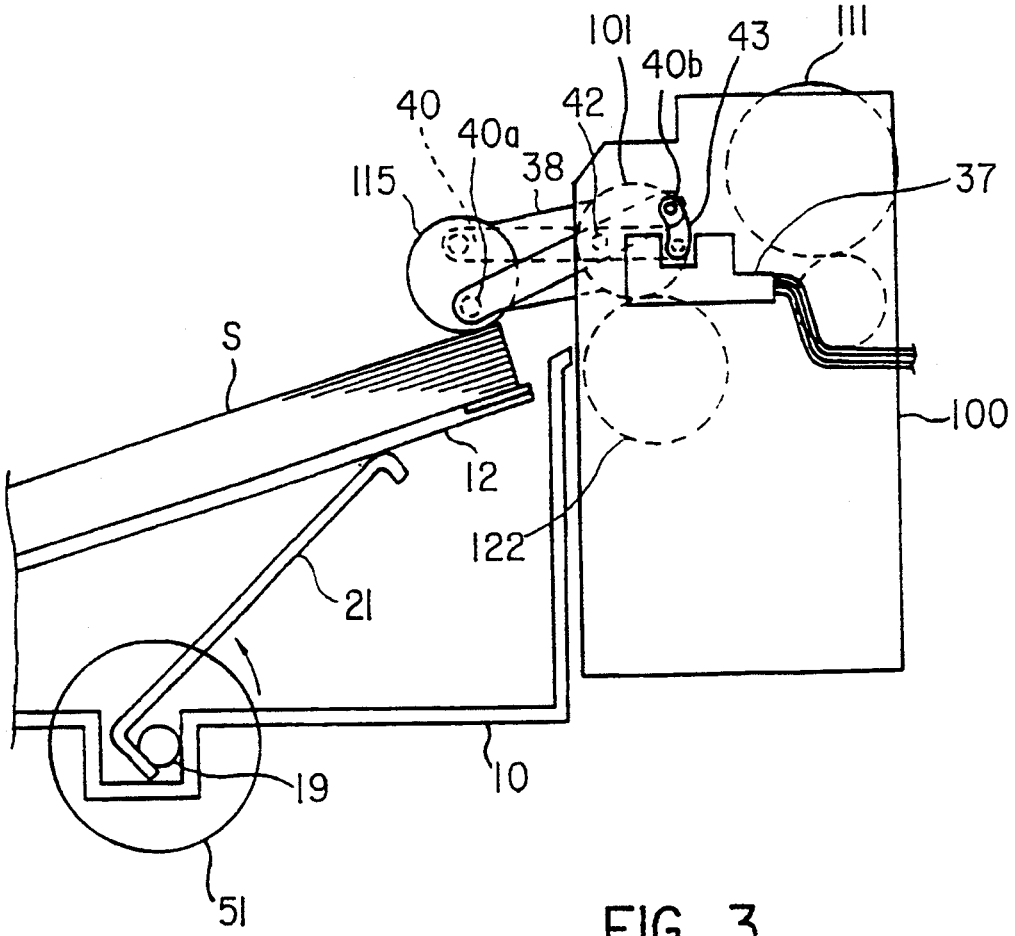
FIG. 3 is a side sectional view of the paper feeding apparatus of the present invention.

A description will now be given of the particularly advantageous aspects of the present invention. Since the structure of each of the paper trays and the corresponding paper sheet separating elements are the same, only the paper sheet tray 10 and corresponding sheet separating elements will be explained. As shown in FIGS. 2 and 3, curl holding members or paper holding members 40 and 41 in the paper sheet feeding apparatus 50 are respectively provided on side boards 100 and 200. The side boards 100, 200 are thus associated with, or part of, the main body of paper sheet feeding apparatus. With this structure, since the curl holding member 40 is not provided on the paper sheet tray 10, an operator can easily load paper into the paper tray 10 (i.e., there are no obstacles, associated with the paper tray 10 ).

The paper holding members 40 and 41 extend to the center from both sides of the paper tray 10 so that the paper holding members 40 and 41 can hold the leading ends of all sizes of paper which can be loaded in the paper tray 10. The paper holding members are advantageous in preventing the occurrence of curling in the paper sheets, and also in restraining any curling which might occur prior to or after loading of the paper into the trays. During feeding of the paper from a tray, the holding members may be disposed in contact with the uppermost sheet in the tray. However, as discussed further hereinafter, during feeding it is preferable to dispose the holding members slightly above the uppermost sheet such that they only contact or restrain curls which may occur in the paper. Thus, the holding members 40,41 are referred to as both paper holding members and curl holding members herein. The paper holding members 40 and 41 are rotatably or pivotally mounted about axis 42.

The paper holding members 40 and 41 rotate counterclockwise under the weight of a rod or stick-shaped member 40*a*. Projections 40*b*, are also provided on the ends of the curl holding members 40 and 41, and the projections 40*b* respectively abut against the ends of holes or slots 43 of the side boards 100 and 200. As a result, the rotatable extent of the curl holding members 40 and 41 are limited by cooperation of the holes 43 and projections 40*b*.

The projections 40*b* extend through the side boards 100 and 200. Preferably, the projections 40b are constructed such that they cut or block light from a paper sheet holding member sensor 37 which can be, for example, a transmitting type photointerruptor. When the paper tray 10 is loaded in the main body, a paper lifting motor 51 transmits torque via axis 19 to lift the paper in the tray 10. When the paper tray 10 is loaded in the main body, the paper tray set sensor 30 detects that the paper tray 10 has been loaded. In response, the paper lifting motor 51 rotates, thus rotating the paper lifting axis 19. As shown in FIG. 3, rotation of the axis 19 causes movement of the lifting lever 21, whereby the paper located on a bottom board 12 of the tray are lifted. As the sheets are lifted, they push up a pick-up roller 115, and an associated pick-up roller arm or arm assembly 38 is also lifted. When a paper sheet height detecting sensor 39 detects that the paper has reached a paper feeding position, the paper lifting motor 51 stops.

Since it can be difficult to precisely position the paper with only the lifting movement provided by motor 51, it may be desirable to slightly over extend the lifting movement to a known position, followed by a predetermined retracting movement of the motor 51, such that proper positioning of the paper is ensured. In particular, if the paper lifting motor 51 over runs and pushes up the paper holding members 40 and 41, the projection 40b interrupts the light of the paper holding member sensor 37, and the paper sheet holding member sensor 37 detects that the paper in tray 10 has been overlifted. In response, the paper lifting motor 51 is reversed until the paper holding member sensor 37 detects light, whereby, it is possible to prevent overrun of the lifting of the paper in tray 10, and to properly position the paper at a paper sheet feeding position.

The retracting movement of the motor 51 can also be advantageous in that, if desired, the motor can retract (or lower) the position of the paper such that the holding members are positioned slightly above non-curled sheets, yet still limit curls such that the curls do not obstruct feeding of the sheets from the tray. Thus, once the paper in the tray is at the final feeding position, the holding members may be positioned such that they are in contact with the paper, or such that they are spaced above the paper (i.e., only contacting and restraining curls larger than the spaced amount, while not contacting or obstructing non-curled sheets). In either case, the initial contact can have the additional advantage in assisting feeding or positioning of the paper for feeding by providing the initial pressing on the sheets prior to the retracting movement of the motor 51.

Preferably the paper holding members 40 and 41 are maintained at a higher position than the paper sheet feeding position (i.e., spaced from the top of non-curled sheets), and the curl holding members 40 and 41 do not contact the paper sheets, such that the paper holding members 40 and 41 do not impart friction or otherwise impede feeding of the paper sheets. Further, since the curl holding members 40 and 41 hold only a curling portion of a paper sheet, it is possible to stably feed a paper sheet without skewing and without delaying the feeding of the sheets.

As should be readily apparent from the foregoing, the present invention provides an advantageous and convenient arrangement for avoiding problems associated with curling of paper, particularly at a leading edge of a paper sheet. The arrangement is convenient in that, by mounting the holding members on the body of the apparatus, there is no obstruction to loading or refilling of the paper tray. Further, since the paper holding members are preferably disposed above the paper, they do not interfere with movement of sheets from the tray into the image forming apparatus. Moreover, since the holding rods 40*a* extend across the front edge of the paper, the rods are able to accommodate a variety of paper sizes. In addition, the rods suppress and/or restrain curls at a location which typically is most critical with regard to problems associated with curling of paper, i.e. the leading edge. While curling may also occur at a trailing edge, trailing edge curls have less of a tendency to be caught as a sheet is being fed. Of course, it is to be understood however, that advantageous aspects of the present invention may also be applicable to holding of paper sheets or restraining curls at locations other than the leading edge of the sheets as depicted in the preferred embodiments. Still further, utilizing the sensing arrangement 37, the paper holding members can also advantageously assist in properly positioning paper sheets (or the paper stack) for feeding.

A description will now be given of a paper feeding apparatus relating to an alternate embodiment, with reference to FIG. 4. In this embodiment, the projections 40*b* of the paper holding member 40 are connected to a paper holder moving or elevating solenoid 45 through an assisting arm 46. When the paper holder solenoid 45 turns on, the evacuating solenoid pulls down the projections 40*b*, whereby, the rod-shaped member 40*a* is pushed up and the curl holding member 40 is moved from a paper or curl holding position. Accordingly, as the paper holding members 40 and 41 are held in the up position, it is possible to prevent the paper holding members 40 and 41 from being an obstacle to a paper sheet removing operation, thereby easing removal of paper sheets in case of a paper jam. Particularly for a paper tray of a drawer type, since the curl holding members 40 and 41 can be held in the up position, even when curling in a paper sheet has already occurred prior to a paper loading operation, the curled paper sheet does not become caught by the curl holding members 40 and 41 upon insertion of the tray, thereby further avoiding damage to the paper or the holding members and also avoiding jamming of the apparatus. Further, by providing the movable paper holding members, the possibility of the holding members interfering with insertion of a paper tray is reduced, as is the possibility of damage to the paper holding members during insertion of a paper tray. Although a raising and lowering movement for the paper holding members is shown, it is to be understood that a retracting movement, or other movement (or combination of movements) may be provided to move the paper holding members from a paper holding position. Although not shown in FIG. 4, a sensor 37 may also be provided to assist positioning or to controlling positioning of the paper lifting operation (via motor 51) and the holding member positioning (via solenoid 45).

When the paper tray set sensor 30 detects that the paper tray 10 is not present or not in the loaded position, the paper holder elevating solenoid 45 turns on, thereby raising the holding members. When the paper tray set sensor 30 detects (even during a copying process) that the paper tray 10 is not loaded, the paper holder solenoid 45 also turns on.

A feeding apparatus relating to a further alternate embodiment will now be explained with reference to FIG. 5. In the FIG. 5 embodiment, rollers 44, which are rotatable, are provided at the end of the rod members 40*a*. If desired, the rollers 44 may also be located at a central portion of the rod members 40*a*. When a diameter of the roller 44 is 10 mm to 12 mm and a diameter of the rod member 40*a* is 3 mm, a gap between the paper S and the rod member 40*a* (which restrains curls of the paper sheets) is 3.5 mm to 4.5 mm. Accordingly, it is possible to maintain a constant space between the rollers 44 and the paper sheets 5, thereby preventing the rods 40*a* from being an obstacle to paper sheets feeding. Thus, with the FIG. 5 arrangement, a rolling contact is provided between the paper and the paper holders 40. Further, although the rods 40*a* are spaced from the lowermost portion of the roller 44, the rods nevertheless restrain and/or suppress curls to the space provided underneath the rods 40*a*, thus avoiding adverse situations which can be caused by paper curls without being an obstacle to sheet feeding or loading.

Figure 6:
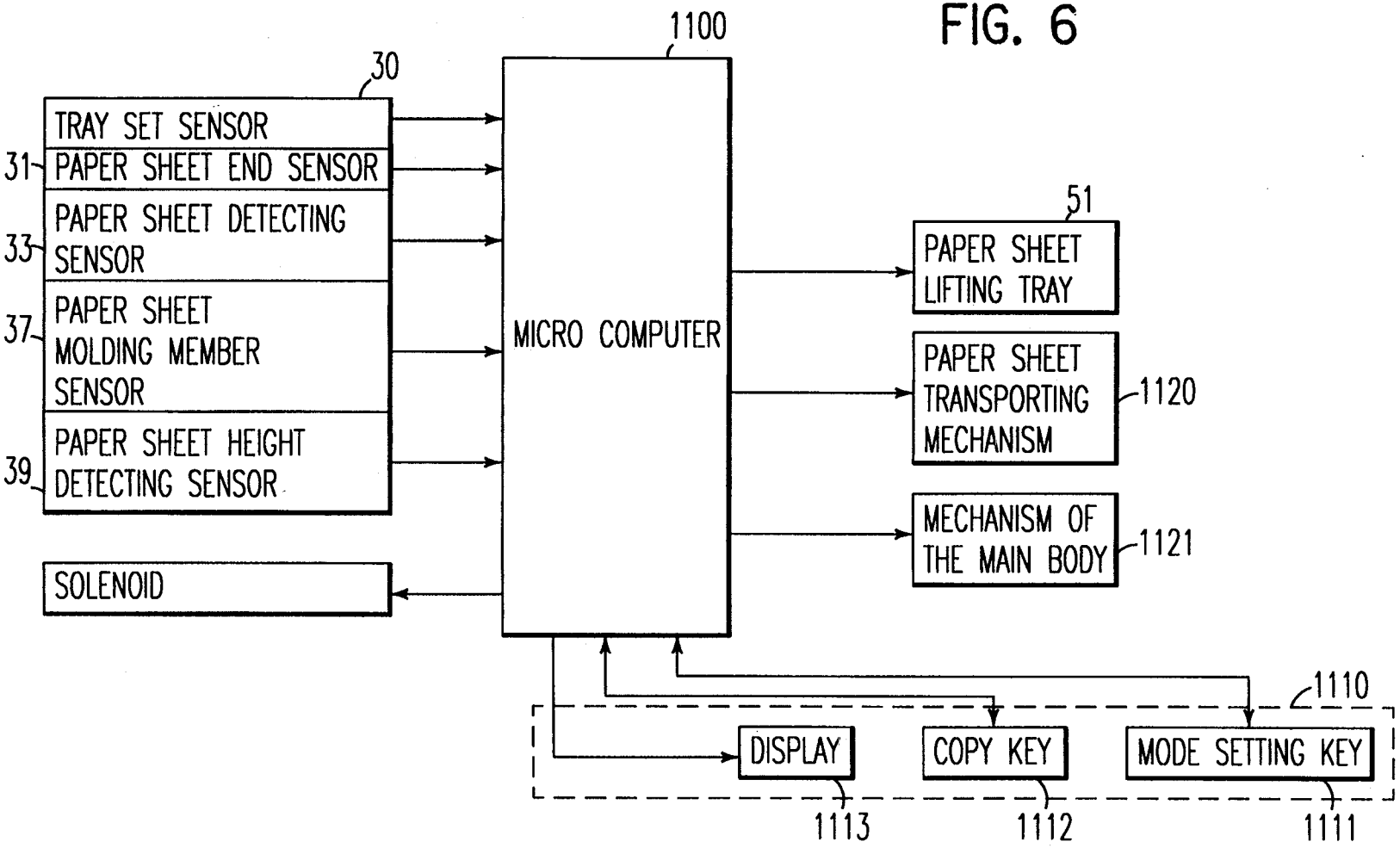
FIG. 6 is a block diagram of the operation of the copying machine.

Next, referring to FIG. 6, a controlling unit of the paper feeding apparatus 50 will be explained. This controlling unit primarily includes a microcomputer 1100, the tray set sensor 30, a paper end sensor 31, the paper detecting sensor 33, the paper holding sensor 37 and the paper height sensor 39, which are connected to the microcomputer 1100.

The tray set sensor 30, which is, for example, a push-switch, is provided so that the tray set sensor 30 is switched on by the end wall of the paper tray 10 when the paper tray 10 is loaded. When the tray set sensor 30 detects that the paper tray 10 is not present, the paper holding member solenoid 45 is driven and the paper holding members 40 and 41 are elevated. Accordingly, since the curl holding members 40 and 41 are elevated when the paper tray 10 is pulled out, it is possible to prevent the curl holding members 40 and 41 from bumping curled paper sheets upon insertion of the tray. Further, since the holding members are automatically elevated, easier access is provided in the event a paper jam should occur.

The paper sheet end sensor 31 is preferably a photosensor of a reflecting type. The paper sheet end sensor 31 performs a scanning operation after a paper sheet is fed or when paper S in the paper tray 10 is lifted and set at the feeding position, and the absence of paper is detected based on the signal from the paper end sensor 31. The paper detecting sensor 33 detects whether there are paper sheets at, or over, a predetermined time, thereby detecting whether a paper jam has occurred.

The paper sheet holding sensor 37 (e.g., as in FIG. 2) is preferably a transmitting type photointerrupter. When the paper S in the paper tray 10 are lifted and reach the paper sheet feeding position, and the paper sheets S push up the rod member 40*a* by over-running of the motor 51 as discussed earlier, and the projection 40*b* interrupts the light from the sensor 37, whereby, it is detected that the curl holding member 40 is in contact with paper sheets S.

The paper height detecting sensor 39 is preferably a transmitting type photointerrupter. When the paper S in the paper tray 10 are lifted, the pick-up roller 115 is pushed up and the pick-up roller arm or arm assembly 38 is rotated and it is determined that the paper sheets S have reached the paper sheet feeding position by interrupting the light from the sensor 39.

The microcomputer 1100 also receives signals from a mode setting key 1111 and a copy key 1112 in an operating panel 1110, and a paper sheet mode is judged. The paper sheet mode refers to the selection of the source from which the paper is to be fed, i.e. depending upon the paper tray, the size of paper desired, or whether the paper is to be manually fed. The paper sheet mode can be manually or automatically selected. Next, the paper sheet transporting mechanism 1120 is driven, and the mechanism 1121 of the main body is controlled. Further, various messages are displayed on a display 1113. Operation of the paper holding solenoid 45 controls movement of the paper sheet holding members 40 and 41 by turning on or off the solenoid 45, and the final position of the paper may also be accomplished with the assistance of the holding members (and sensor 37) to control the reversing movement of the paper lifting motor 51.

Figure 7:
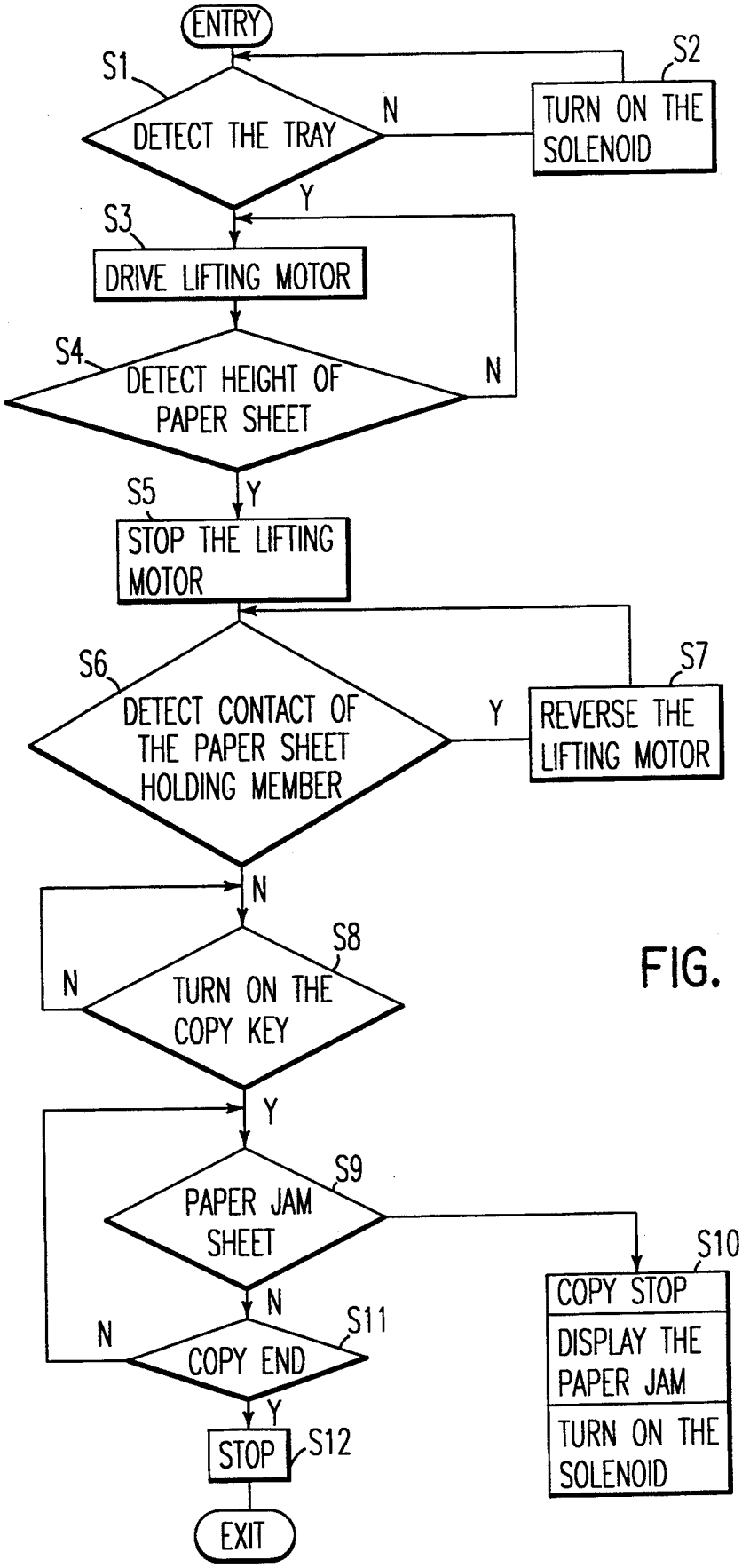
FIG. 7 is a flowchart for controlling operation of the paper feeding apparatus according to the present invention.

Now referring to the flowchart of FIG. 7, elevating (or other retracting) movement of the curl holding member and contacting movement will be explained. When the tray set sensor 30 detects that the paper tray 10 has not been loaded (No in S1), the paper holding member solenoid 45 is turned on (S2). The tray set sensor 30 continues to detect the tray during a copying process. If the tray set sensor 30 detects that the paper sheet tray 10 is not loaded, the paper sheet holding solenoid 45 is turned on.

If the tray set sensor turns on (Yes in S1), the upper surface of the paper S in the paper tray 10 is raised or lifted (S3). When the upper surface of the paper S reaches to paper sheet feeding position, the paper height sensor 39 detects the paper (Yes in S4) and the paper lifting motor 51 stops (S5). The paper sheet holding sensor 37 detects contact with the paper sheets S (or, more specifically, detects the over-extended position of the protrusions 40*b* of the holding members 40 which results from contact with the paper) and the paper lifting motor 51 reverses (S7) until the paper sheet holding sensor 37 does not sense contact or more particularly, the sensor 37 does not detect the over extended position of the protrusion 40*b* and the answer is No in S6.

When a paper jam occurs (Yes in S9) during the copying process (Yes in S8), the copying process stops, and the display 1113 displays a paper jam message and the paper holding solenoid 45 turns on (S10). Thus, the holding members 40*a* are elevated, easing removal of jammed sheets. If a paper jam does not occur (No in S9) the copying process continues until finished, and the routine stops (S12).

As should be apparent from the foregoing, the present invention thus eliminates or at least reduces problems associated with curling of paper in an image forming apparatus. Further, the present invention avoids the imposition of additional obstacles to sheet feeding, loading of paper into paper trays and loading of paper trays into the apparatus. In addition, the present invention also provides for convenient access by an operator in the event a paper jam should occur.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A paper sheet feeding apparatus comprising:
a main body;
a movable paper tray; and
a paper holding member for restraining curling of an end portion of paper disposed in the paper tray, said paper holding member mounted on the main body, wherein said paper holding member is located at a higher position than a top end portion of paper disposed in said paper tray so as not to touch paper sheets which have no curl.

2. A paper sheet feeding apparatus according to claim 1, further including a paper holding member sensor provided on the main body so as to detect contact of said paper holding member with paper sheets, said apparatus further including means for raising and lowering paper sheets loaded within said tray, thereby raising and lowering a sheet feeding position, said means for raising and lowering responding to said paper holding member sensor such that a paper sheet feeding position is lowered when said paper holding member sensor detects contact of said paper holding member.

3. A paper sheet feeding apparatus according to claim 1, further including a roller provided on said paper holding member, wherein said roller contacts a center portion of a sheet and rotates during feeding of a sheet from said paper tray.

4. A paper sheet feeding apparatus according to claim 1, wherein said paper holding member extends toward a center position from a side of said paper tray, whereby said paper holding member holds an end of varying sizes of papers which can be loaded in said paper portion tray.

5. A paper sheet feeding apparatus comprising:
a main body:
a movable paper tray; and
a paper holding member for restraining curling of an end portion of paper disposed in the paper tray, said paper holding member mounted on the main body;
the apparatus further including means for movably mounting said paper holding member and moving means for elevating said paper holding member away from paper sheets located in said paper tray.

6. According to claim 5, wherein said moving means elevates said paper holding member in response to a paper jam signal.

7. A paper sheet feeding apparatus according to claim 5, further including a tray set sensor provided on the main body to detect whether said paper tray is loaded in the main body, wherein said moving means elevates said paper sheet holding member in response to a signal from said tray set sensor that said paper tray is not loaded in the main body.

8. The apparatus of claim 5, wherein said means for movably mounting said paper holding member includes an arm pivotably connected to said main body.

9. The apparatus of claim 8, wherein said arm includes a projection extending therefrom, said projection extending into a slot provided on said main body such that a range of pivoting movement of said paper holding member is limited by cooperation of said projection and said slot.

10. The apparatus of claim 8, wherein said arm includes a projection extending therefrom, and wherein said projection moves during movement of said paper holding member, and further wherein a sensor is disposed adjacent at least a portion of a path of movement of said projection to thereby sense a position of said projection and said paper holding member.

11. A paper feeding apparatus comprising: a tray for holding a stack of paper sheets;
means for feeding paper sheets from said tray in a first direction; and
a holding member disposed at a leading edge position of paper disposed in said tray, with said leading edge position with respect to said first direction of feeding of said paper sheets;
wherein said holding member extends in a second direction perpendicular to said first direction, whereby said holding member restrains curling of paper sheets disposed in said tray and wherein said holding member is mounted separate from said tray, with said holding member mounted on a body portion of said paper feeding apparatus, and further wherein said holding member is movably mounted with respect to said body portion, the apparatus further including an arm connecting said holding member to said body portion, and wherein said arm is pivotably connected to said body portion thereby providing the movable mount of said holding member.

12. The paper feeding apparatus of claim 11, wherein a pair of holding members are provided, each pivotably mounted to respective body portions of said paper feeding apparatus.

13. The paper feeding apparatus of claim 11, further including means for sensing a position of said holding member.

14. The paper feeding apparatus of claim 13, further including means for lifting and lowering paper disposed in said tray, and wherein said means for lifting and lowering and said means for sensing a position of said holding member are connected to a control unit.

15. The paper feeding apparatus of claim 14, wherein said control unit includes means for controlling movement of paper by said means for lifting and lowering in response to a signal from said means for sensing a position of said holding member.

16. The apparatus of claim 11, further including a projection extending from said arm at a location such that said projection moves during pivoting movement of said arm, said projection extending into a slot provided on said body portion of said apparatus such that a range of pivoting movement of said holding member is limited by cooperation of said projection and said slot.

17. The apparatus of claim 11, wherein said arm includes a projection extending therefrom, and wherein said projection moves during movement of said holding member, and further wherein a sensor is disposed adjacent at least a portion of a path of movement of said projection to thereby sense a position of said projection and said holding member.

18. A paper feeding apparatus comprising:

a tray for holding a stack of paper sheets;

means for feeding paper sheets from said tray in a first direction;

a holding member disposed at a leading edge position of paper disposed in said tray, with said leading edge position with respect to said first direction of feeding of said paper sheets;

wherein said holding member extends in a second direction perpendicular to said first direction, whereby said holding member restrains curling of paper sheets disposed in said tray; and wherein a pair of said holding members are provided, each including a rod-like member extending in a direction orthogonal to said first direction, and wherein a first of said pair extends in a direction opposite to a direction in which a second of said pair extends.

19. The paper feeding apparatus of claim 18, wherein said pair of holding members are pivotably mounted on a body of said paper feeding apparatus.

20. A paper feeding apparatus comprising:

a tray for holding a stack of paper sheets;

means for feeding paper sheets from said tray in a first direction;

a holding member disposed at a leading edge position of paper disposed in said tray, with said leading edge position with respect to said first direction of feeding of said paper sheets;

wherein said holding member extends in a second direction perpendicular to said first direction, whereby said holding member restrains curling of paper sheets disposed in said tray;

the apparatus further including means for holding said holding member at a location spaced above a topmost surface of paper loaded in said tray, such that said holding member is held out of contact with sheets not having curls while restraining curls larger than a predetermined amount.

21. A paper feeding apparatus comprising:

a main body;

a paper tray;

paper holding member movably mounted upon said main body and extending to a location above said paper tray to restrain curling of paper disposed in said paper tray; and the apparatus further including means for maintaining said holding member at a location spaced from a surface of non-curled paper, while contacting paper having a curl to thereby restrain paper curls.

22. The paper feeding apparatus of claim 21, wherein a pair of said paper holding members are provided, each pivotably mounted upon said main body.

23. A paper feeding apparatus comprising:

a main body;

a paper tray;

a paper holding member movably mounted upon said main body and extending to a location above said paper tray to restrain curling of paper disposed in said paper tray, wherein a pair of said paper holding members are provided, each paper holding member including a respective movable mounting member connected to said main body to thereby provide a movable mount for each paper holding member, each of said paper holding members further including a rod connected to each respective movable mounting member.

24. The paper feeding apparatus of claim 23, wherein the rod of one of said pair extends in a direction opposite to a direction in which the rod of a second of said pair extends.

* * * * *